US005364195A

United States Patent [19]

Kanemitsu et al.

[11] Patent Number: 5,364,195

[45] Date of Patent: Nov. 15, 1994

[54] SHEET CONVEYING APPARATUS WITH DISPLACEABLE GUIDE BETWEEN CASSETTE AND FEED ROLLER

[75] Inventors: Shinji Kanemitsu; Shigeyoshi Onoda, both of Yokohama; Keiko Okuma, Tokyo; Hiroshi Nakai, Yokohama, all of Japan

[73] Assignee: Canon Kabushiki Kaisha, Tokyo, Japan

[21] Appl. No.: 992,768

[22] Filed: Dec. 18, 1992

[30] Foreign Application Priority Data

Jan. 7, 1992 [JP] Japan ..... 4-018487
Jan. 7, 1992 [JP] Japan ..... 4-018488
Jan. 7, 1992 [JP] Japan ..... 4-018489

[51] Int. Cl.[5] ..... B41J 11/50

[52] U.S. Cl. ..... 347/4; 400/624; 271/117; 271/121; 271/138; 346/76 PH

[58] Field of Search ..... 400/624, 625, 629, 605, 400/126; 271/9, 10, 114, 117, 118, 121, 126, 127, 137, 138, 167; 355/309, 313, 314; 346/76 PH

[56] References Cited

U.S. PATENT DOCUMENTS 4,394,008 7/1983 Sugiyama ..... 271/118
4,544,262 10/1985 Kanemitsu et al. ..... 101/DIG. 13
4,572,648 2/1986 Toriumi et al. .
4,577,984 3/1986 Yamamoto et al. ..... 400/629
4,653,743 3/1987 Ebata et al. ..... 271/124
4,676,498 6/1987 Kanemitsu et al. ..... 271/251
4,798,374 1/1989 Ito ..... 271/126
5,108,084 4/1992 Ishikawa et al. ..... 271/117
5,181,708 1/1993 Ruch ..... 271/121
5,297,018 3/1994 Kashimura ..... 400/605

*Primary Examiner*—Eugene H. Eickholt
*Attorney, Agent, or Firm*—Fitzpatrick, Cella, Harper & Scinto

[57] ABSTRACT

A sheet conveying apparatus includes a sheet accommodating unit for accommodating a plurality of sheets, a sheet feeding unit for feeding sheets from the sheet accommodating unit, separation pawls for individually separating the sheets fed from the sheet feeding unit, a manual feeding port for manually feeding a sheet between the sheet accommodating unit and the sheet feeding unit, and a manually-fed-sheet guiding unit disposed between the sheet accommodating unit and the sheet feeding unit for guiding the sheet manually fed from the manual feeding port. The manually-fed-sheet guiding unit is displaceable an amount sufficient to allow the formation of a loop in a sheet during the separation by the separation pawls.

12 Claims, 19 Drawing Sheets

SHEET CONVEYING APPARATUS WITH DISPLACEABLE GUIDE BETWEEN CASSETTE AND FEED ROLLER

BACKGROUND OF THE INVENTION

1. Field of the Invention

This invention relates to a sheet conveying apparatus which includes a displaceable sheet conveying guide in a sheet conveying path provided between a cassette and a sheet-feeding roller.

2. Description of the Related Art

Heretofore, a sheet conveying path between a cassette and a sheet-feeding roller has, in general, been used as a conveying path for conveying a sheet which has been manually fed. Accordingly, the sheet conveying path is provided between the cassette and the sheet-feeding roller only when a sheet is manually fed, enabling a manual feeding operation of paper, and is retracted during a usual sheet feeding operation from the cassette so as not to obstruct the sheet feeding operation from the cassette.

In some printers, a sheet can be conveyed in a forward or a reverse direction. In such a case, the above-described sheet conveying path is utilized as a space for accommodating a sheet. That is, the sheet-feeding roller is retracted from the sheet conveying path by swinging in order to secure the sheet conveying path, and a cover on the upper surface of the cassette is utilized as a sheet guide.

In the above-described first approach, however, it is necessary to perform the difficult operation of providing the sheet conveying path at a predetermined position every time a manual feeding operation of a sheet is performed, and retracting the sheet conveying path when the path is not used. Hence, an apparatus must provide a space for accommodating the sheet conveying path, causing an unnecessary increase of the size of the apparatus. In the above-described case of printers, a mechanism to retract the sheet-feeding roller is required in order to secure the sheet conveying path. Moreover, the sheet conveying path is not provided when the cassette is detached, and therefore sheets cannot be accommodatad at a predetermined position.

SUMMARY OF THE INVENTION

It is an object of the present invention to overcome the above-described problems in the prior art.

According to one aspect of the present invention, there is provided a sheet conveying apparatus which includes sheet accommodating means for accommodating a plurality of sheets, sheet feeding means for feeding sheets from the sheet accommodating means, separation pawls for individually separating the sheets fed from the sheet feeding means, a manual feeding port for manually feeding a sheet to a position between the sheet accommodating means and the sheet feeding means, and manually-fed-sheet guiding means disposed between the sheet accommodating means and the sheet feeding means for guiding the sheet manually fed from the manual feeding port. The manually-fed-sheet guiding means is displaceable an amount sufficient to allow formation of a loop in a sheet during the separation by the separation pawls.

According to such a configuration, since the manually-fed-sheet guiding means for guiding a manually fed sheet is flexible enough to displace an amount sufficient to allow the formation of a loop, even if the loop contacts the manually-fed-sheet guiding means during the separation of an individual sheet by the separation pawls, the manually-fed-sheet guiding means can be provided close to the sheet accommodating means, whereby the size of the apparatus can be reduced.

In yet another aspect of the invention, a discharging port for a sheet fed from the sheet accommodating means may also be used as the manual feeding port for a sheet. In such a case, a sheet manually fed from the discharging port is temporarily kept in a standby state alongside the sheet accommodating means by the guiding means, and is fed again to the discharging side. Thus, the handling of a sheet which has been fed from the sheet accommodating means and discharged and manual feeding of a sheet can be performed from the same side of the apparatus, whereby the operability of the apparatus can be improved.

In still yet another aspect of the above-described sheet conveying apparatus, there is provided a conveying means for conveying a sheet separated by the separation pawls out of the sheet accommodating means in a first direction to a downstream position and for conveying a sheet from the downstream position in a second direction reverse to the first direction. A guiding means is disposed between the sheet accommodating means and the sheet feeding means as described above for guiding the sheet being conveyed in the second direction and is displaceable an amount sufficient to allow formation of a loop in a sheet during separation by the separation pawls.

These and other aspects of the invention will become even further apparent in light of the following drawings and detailed description thereof.

BRIEF DESCRIPTION OF THE DRAWINGS

FIG. 12(*b*) is an enlarged view of portion B shown in FIG. 12(*a*);

DETAILED DESCRIPTION OF THE PREFERRED EMBODIMENTS

An embodiment of the present invention will now be described in detail with reference to the drawings.

Figure 1:
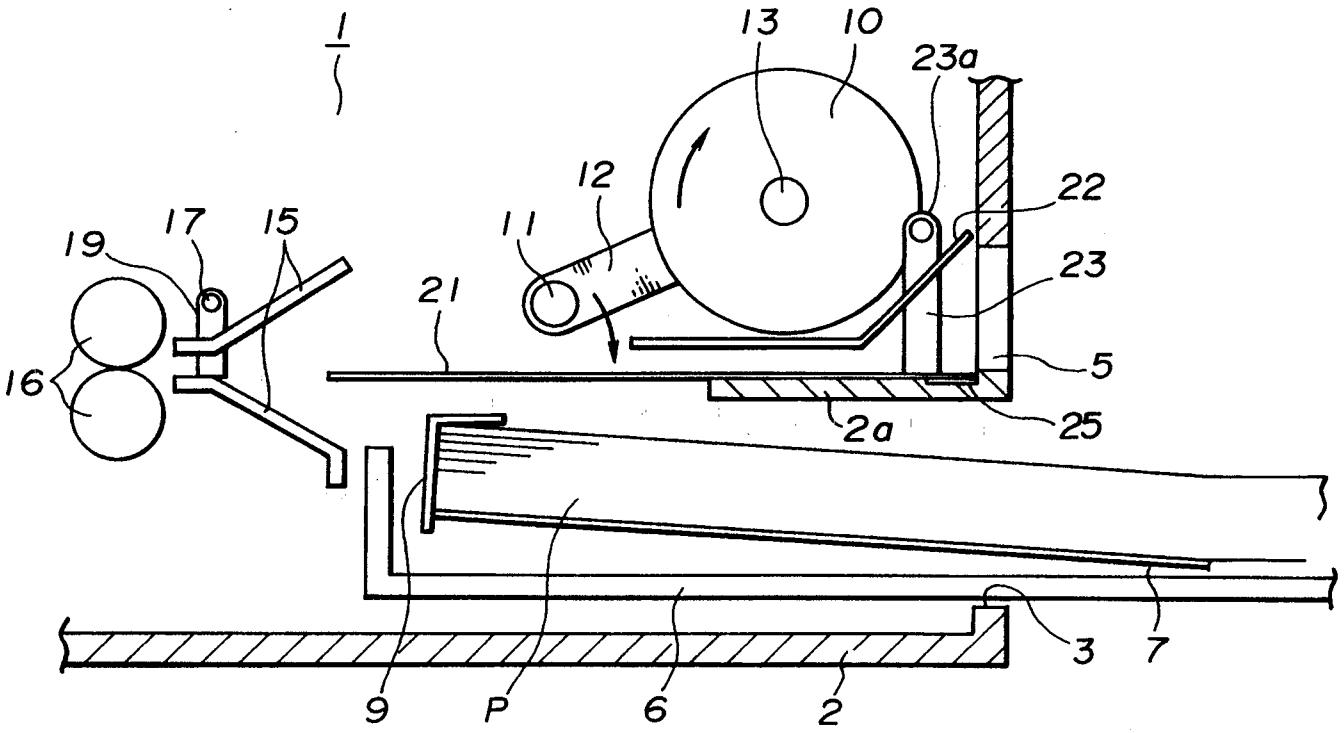
FIG. 1 is a cross-sectional view of a manual sheet feeding unit according to an embodiment of the present invention.

FIG. 1 is a cross-sectional view of a manual sheet feeding unit of printer 1, the printer 1 serving as an image forming apparatus, according to an embodiment of the present invention. Cassette 6 accommodates sheets P so that sheets P are individually separated and fed by separation pawls 9. Arm 12 is rotatably supported at its base portion by shaft 11. Pickup roller (sheet-feeding roller) 10 is pivotably mounted at a free end of arm 12 by shaft 13, and roller 10 is usually supported in a standby position as shown in FIG. 1. Opening 5 for manual sheet feeding and opening 3 for cassette 6 are provided in main body 2 of the apparatus. Guide 21 and guide 22 are provided between cassette 6 and sheet-feeding roller 10 and form a manual sheet feeding path for conveying a manually fed sheet. Guide 21 is made of a flexible material.

An upstream end portion of the guide 21 is mounted on mounting unit 2*a* formed on main body 2 of the apparatus parallel to the sheet-feeding direction.

Figure 2:
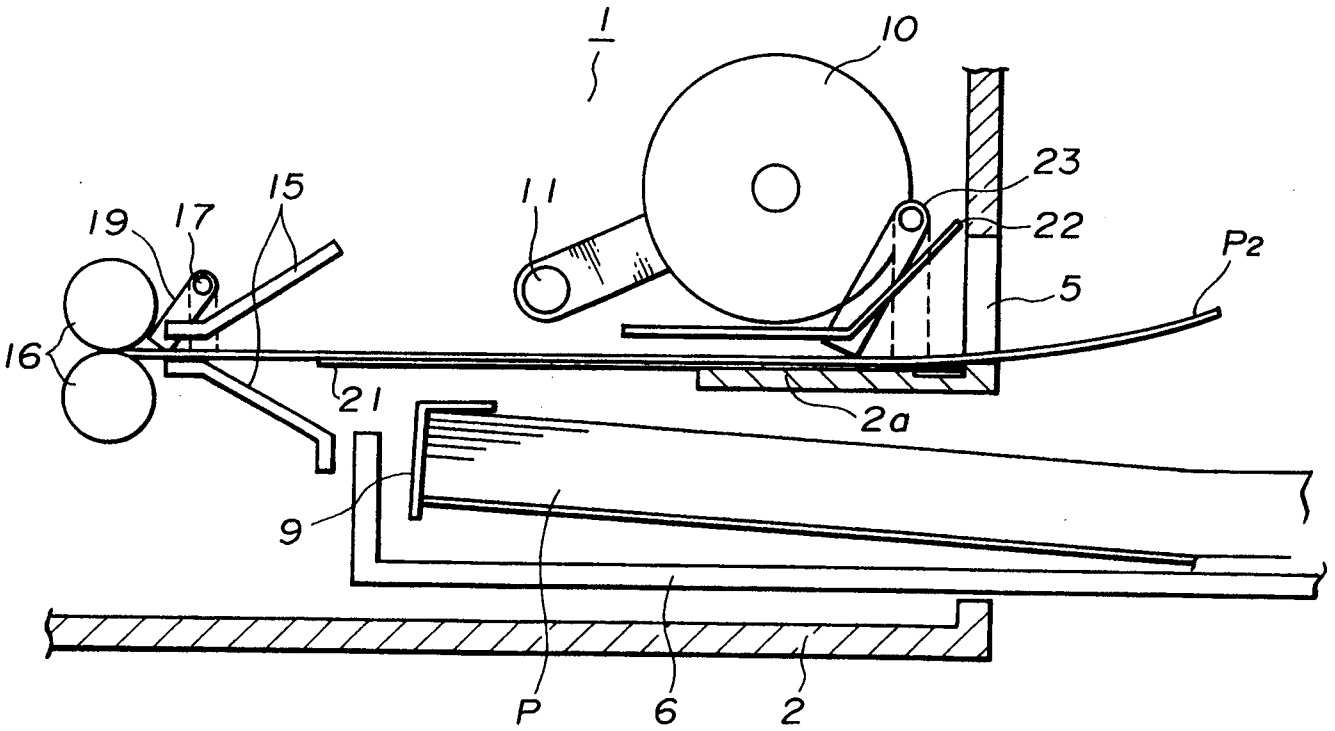
FIG. 2 is a diagram illustrating the embodiment of FIG. 1 as a sheet is manually fed in the unit.

FIG. 2 illustrates the manual feed operation of the unit shown in FIG. 1. When manually fed sheet $P_2$is inserted through opening 5 for manual feeding, sheet $P_2$contacts lever 23 causing it to swing upward, thereby generating a manual-sheet-feeding signal. Sheet $P_2$ passes through the conveying path formed by guides 21 and 22 and reaches conveying guides 15 provided in main body 2 of the apparatus. At that time, since sheet-feeding roller 10 is retracted to an upward position, it does not obstruct the feeding operation of sheet $P_2$. Subsequently, by swinging detection lever 19 around supporting shaft 17, thereby detecting the completion of a sheet setting operation, conveying rollers 16 provided in main body 2 of the apparatus start to rotate and convey sheet $P_2$, whereby the manual sheet feeding operation is completed.

Figure 3:
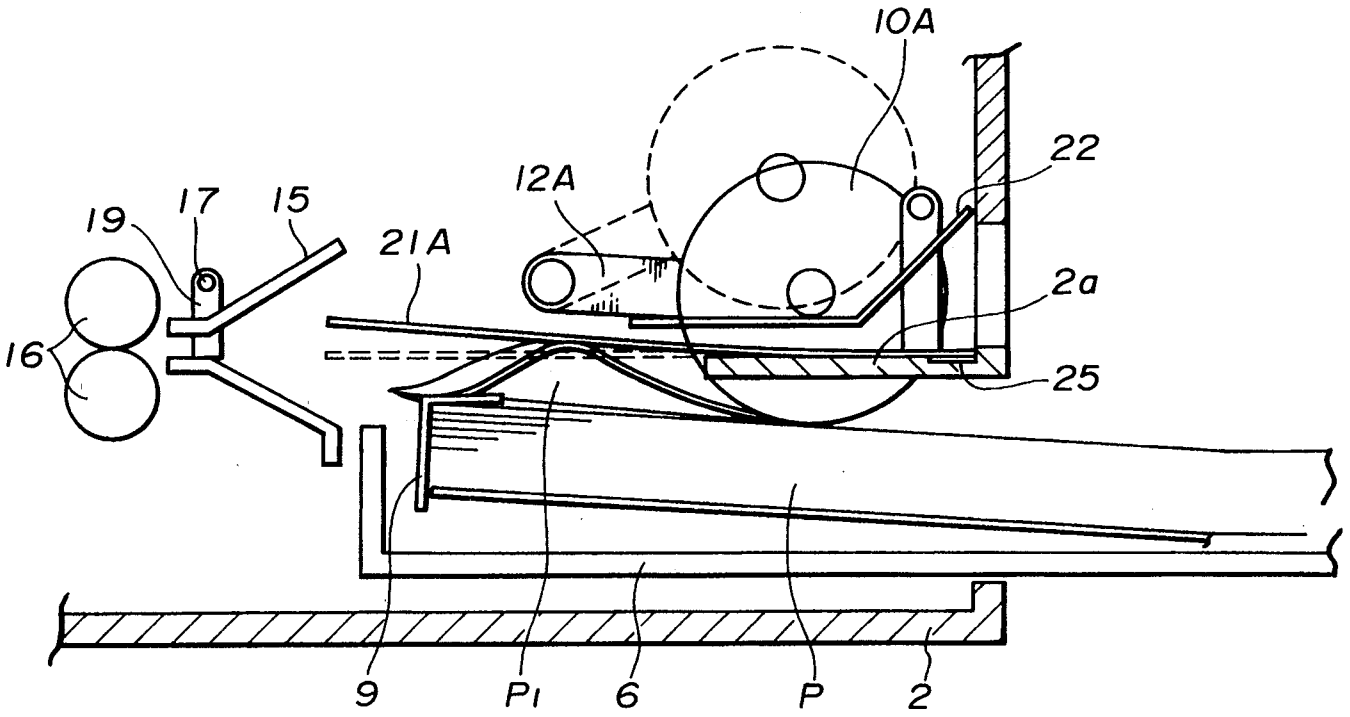
FIG. 3 is a diagram illustrating the embodiment of FIG. 1 as a sheet is fed from a cassette in the unit.

Next, a description will be provided of a sheet feeding operation from the cassette with reference to FIG. 3. When a sheet-feeding-from-cassette signal has been received, sheet-feeding roller 10 is lowered to position 10A where it contacts sheets P accommodated in cassette 6. Sheet feeding roller 10 is lowered by rotation of arm 12 to position 12A. Sheet-feeding roller 10 separates and feeds the uppermost sheet $P_1$ in cooperation with separation pawls 9. At that time, as can be understood from FIG. 4, a leading-end portion of sheet $P_1$ near separation pawls 9 is raised by separation pawls 9 to produce a loop. Since guide 21 is made of a flexible material and is attached only at point 25 which is upstream from sheet-feeding roller 10 in the sheet-conveying direction, guide 21 easily moves to position 21A without obstructing the formation of the loop of sheet $P_1$, whereby the separation operation is completed.

Figure 4:
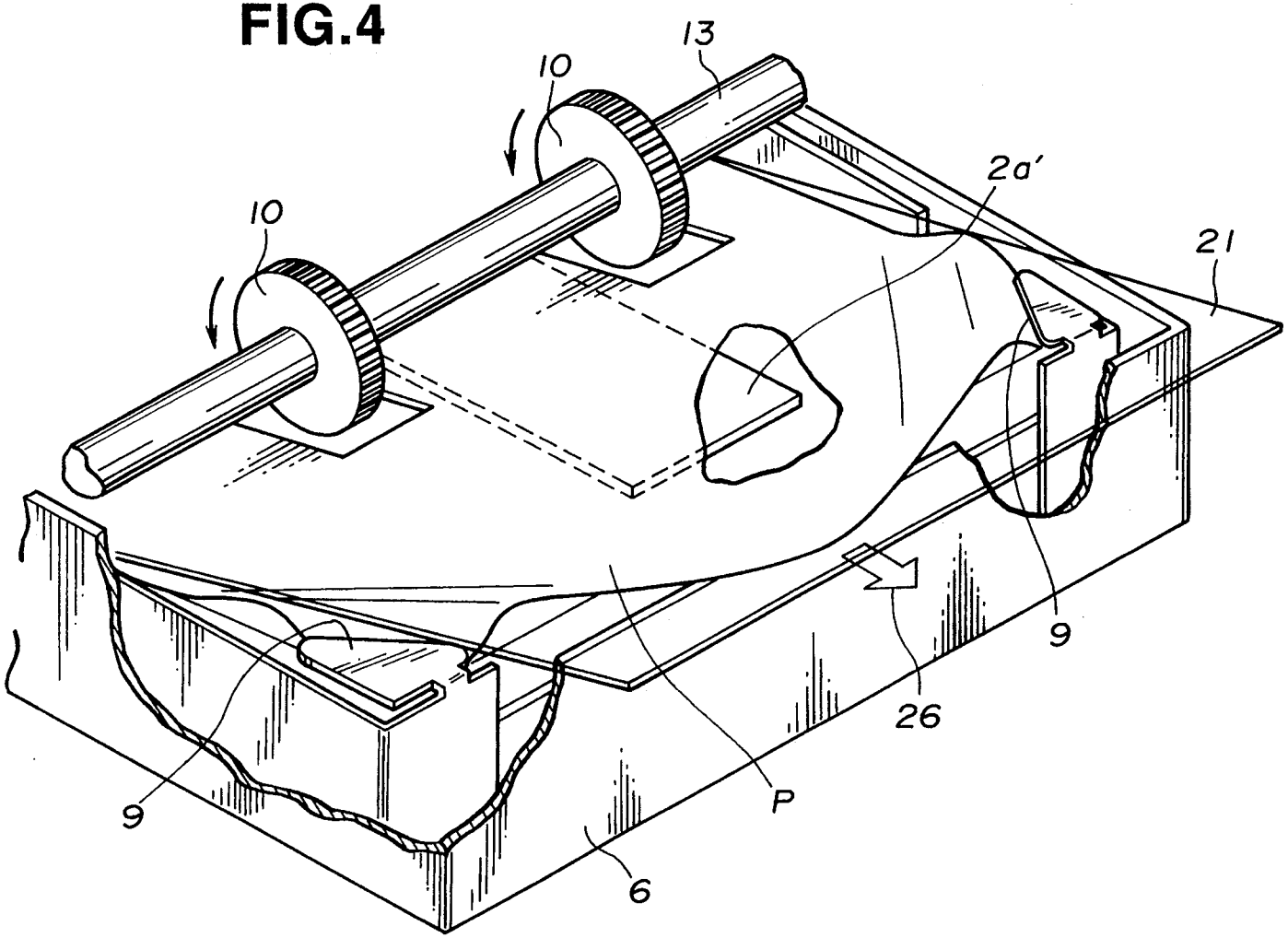
FIG. 4 is a perspective view showing a loop formed in a sheet fed from the cassette in the embodiment shown in FIG. 1.

As can be understood from FIG. 4, the portion of mounting unit 2*a* that supports guide 21 may be extended to position 2*a*′ downstream of sheet-feeding roller 10 in the sheet feeding direction without interfering with the loop of sheet $P_1$ produced near separation pawl 9. According to such a configuration, it is possible to effectively prevent bending of sheet guide 21 in a manual sheet feeding operation.

Figure 5:
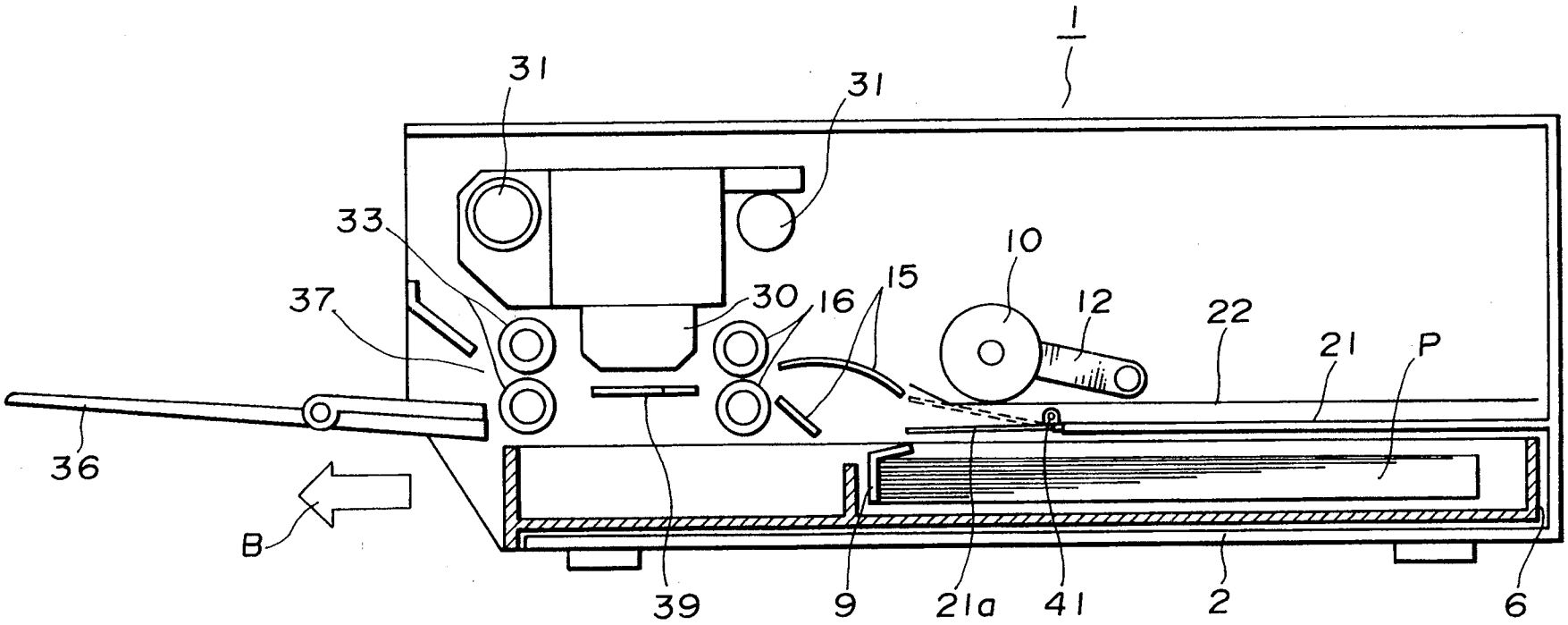
FIG. 5 is a cross-sectional view of a printer in which a sheet can be rotated both in a forward direction and in a reverse direction according to another embodiment of the present invention.

Next, a description will be provided with reference to FIG. 5 of a printer in which a sheet can be conveyed both in a forward direction and a reverse direction with reference to FIG. 5.

FIG. 5 is a cross-sectional view of printer 1 which uses ink-jet head 30 as recording means, and performs recording by repeating serial scanning on sheet P along scanning rail 31. Respective pairs of sheet-conveying rollers 16 and 33 can rotate both in a forward direction and a reverse direction. Hence, if, for example, a sheet on tray 36 is fed through opening 37 of main body 2 of the apparatus and is conveyed by the pair of rollers 33, the sheet passes through the pair of rollers 16 and is accommodated within the sheet conveying path formed by guides 21 and 22. During this operation, sheet-feeding roller 10 is upwardly retracted by supporting arm 12, in the same manner as described above, so as not to obstruct the sheet conveying path. By thereafter rotating the respective pairs of rollers 16 and 33 in a forward direction, recording is performed on sheet P using ink-jet head 30. Such ink jet recording devices are illustrated, for example, in U.S. Pat. Nos. 4,313,124, 4,345,262, 4,558,333, 4,740,796, and 4,723,129, each assigned to the assignee of the present application. In the case of a sheet feeding operation from the cassette, sheet-feeding roller 10 descends in the same manner as described above to separate and feed sheets P. Since the portion of guide 21 downstream from sheet-feeding roller 10 in the sheet-conveying direction includes flexible thin-plate member 21*a* mounted around rotation axis 41, guide 21 moves to a position indicated by a broken line when a loop is produced in sheet P. Hence, the separation performance is not obstructed.

Figure 6:
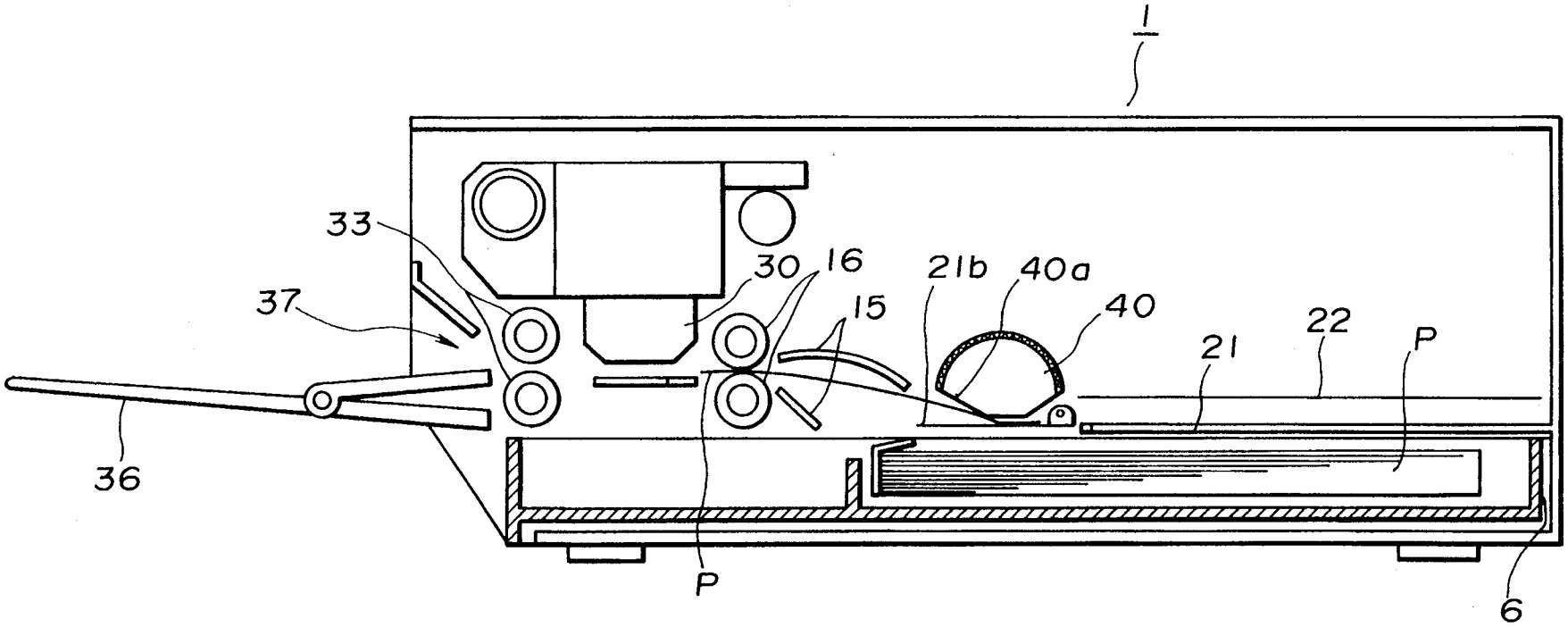
FIG. 6 is a cross-sectional view of a printer which utilizes a semicircular roller according to still another embodiment of the present invention.

Next, with reference to FIG. 6, a description will be provided of the configuration of a sheet conveying path when a sheet-feeding roller obtained by cutting part of a cylinder (hereinafter termed a D-cut roller) is used. The configuration shown in FIG. 6 is the same as the configuration of the above-described embodiment except for the use of D-cut roller 40, which serves as a sheet-feeding roller. When D-cut roller 40 is used, portion 40*a* of D-cut roller 40, which does not contact sheet P, can face the sheet P, whereby a space is provided between cassette 6 and D-cut roller 40.

Accordingly, a swinging operation to retract sheet-feeding roller 10 performed in the above-described embodiment becomes unnecessary. However, since a jam will occur if sheet P is caught by D-cut roller 40 when sheet P is introduced into the sheet conveying path, the apparatus is configured so that sheet P will be introduced in the sheet conveying path by a flange portion 40*a* of D-cut roller 40 which acts as a guide. Although in the present embodiment flange portion 40*a* of D-cut roller 40 is used as a sheet guide, another guide member may, of course, be provided along the driving shaft of the sheet-feeding roller.

By providing a sheet conveying path between a cassette and a sheet-feeding roller, and making at least a part of a sheet guide provided in the sheet conveying path downstream from the sheet-feeding roller to be displaceable toward the sheet-feeding roller, the sheet conveying path can be constantly provided at a predetermined position. Consequently, added operations to enable manual feeding are unnecessary, and it becomes possible to easily perform a manual sheet feeding operation. Moreover, by using a D-cut roller as a sheet-feeding roller and guiding a sheet by a flange portion of the D-cut roller, it becomes possible to secure a sheet conveying path merely by fixing the position of the sheet-feeding roller, whereby the configuration of an apparatus is simplified and the production cost can be reduced.

Figure 7:
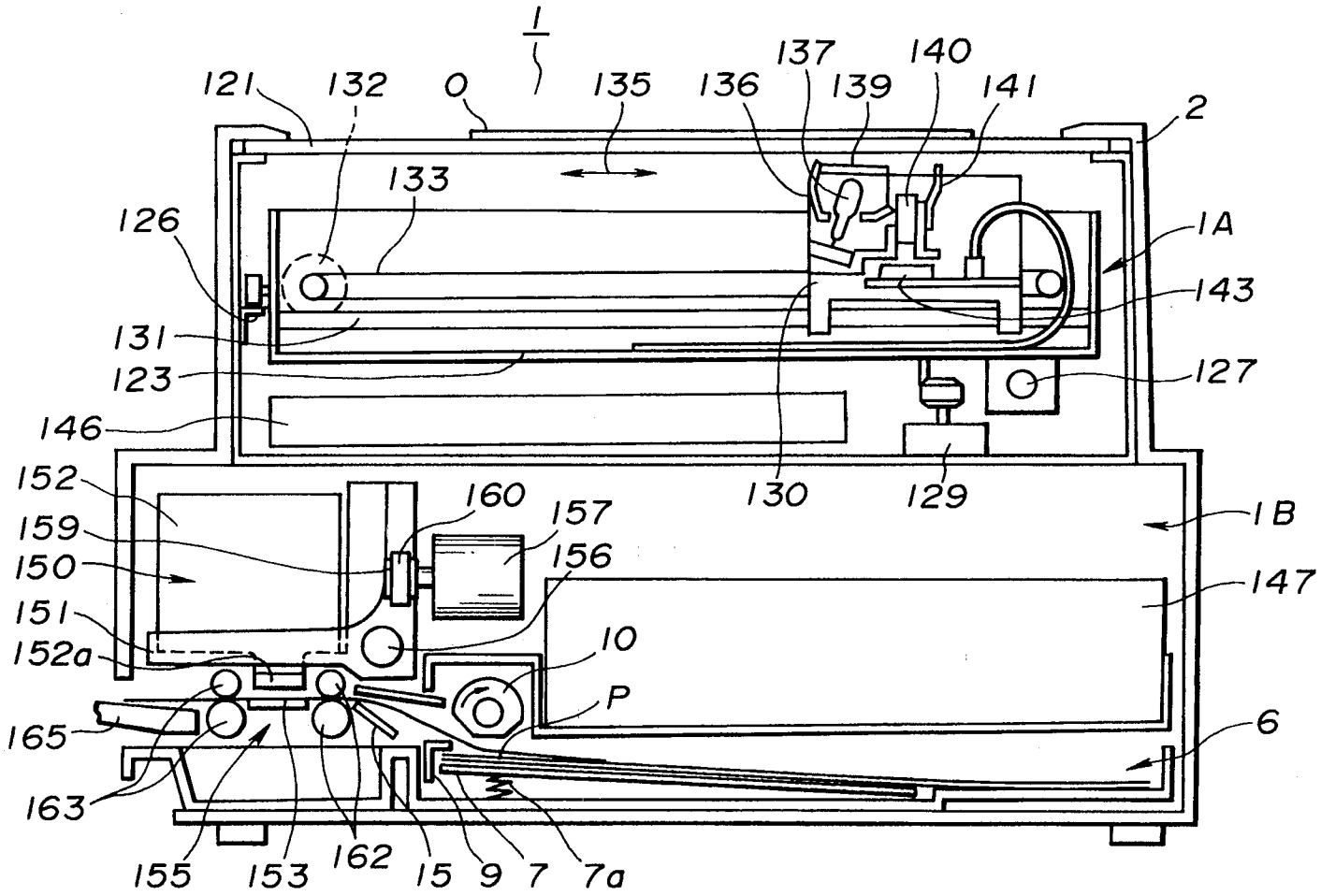
FIG. 7 is a cross-sectional view of a copier according to still another embodiment of the present invention.

A description will now be provided of a copier according to another embodiment of the present invention with reference to FIG. 7.

Copier 1 comprises reading unit 1A for reading image information corresponding to an original, and recording unit 1B for printing an image corresponding to the image information. Platen glass 121 on which original 0 is mounted is disposed on main body 2 of copier 1. Frame 123 for reading unit 1A is supported so as to be movable under power of motor 129 in a direction perpendicular to the plane of FIG. 1 along guide rail 126 and guide member 127. Carriage 130 disposed within frame 123 is supported by guide member 131 so as to be movable in the directions of two-headed arrow 135, and is driven by a driving system comprising a plurality of pulleys 132, belt 133 and the like.

In accordance with movement of carriage 130 in the directions of two-headed arrows 135, image information on original 0 is read by an optical system comprising lamp 137, covers 136 and 141, condenser lens 140 and the like provided in carriage 130, and the image information is converted into an electrical signal by photoelectric transducer 143. The image information is transmitted to control unit 147 of recording unit 1B via electric unit 146.

Cassette 6 provided at a lower portion of recording unit 1B includes intermediate plate 7 for mounting sheets P thereon, pressure spring 7*a* for upwardly pressing intermediate plate 7, separation pawls 9 and the like. Sheets P are individually separated by the rotation of sheet-feeding roller 10 in the direction of the arrow, and each of the separated sheets P is fed to printing unit 155. Printing unit 155 includes platen 153, respective pairs of conveying rollers 162 and 163 provided before and after platen 153, recording unit 150 and the like. Carriage 151 which supports ink-jet unit 152 of recording unit 150 is movably supported and guided by guide member 156, and is driven by a driving system comprising motor 157, pulley 159, belt 160 and the like.

Recording unit 150 discharges ink from head unit 152*a* as ink-jet unit 152 moves in the direction of the width of sheet P, and prints an image corresponding to image information from the above-described reading unit 1A on sheet P. There are also shown guide plate 15 for guiding sheet P fed from cassette 6 to recording position 155, and sheet discharge tray 165.

Preferred embodiments of cassettes to be used in the above-described copier 1 will now be described.

Figure 8:
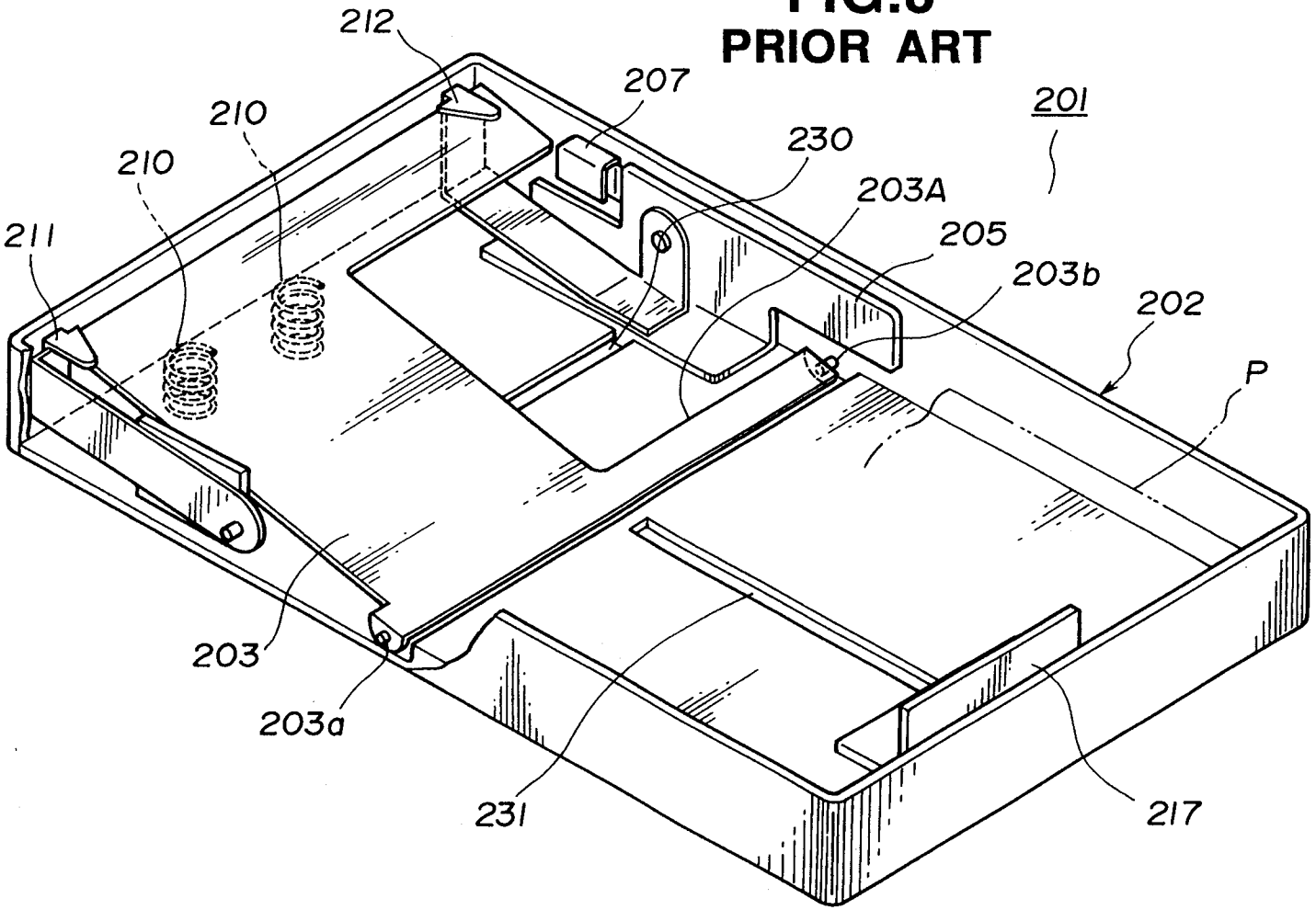
FIG.8 PRIOR ART
FIG. 8 is a perspective view of a conventional cassette.
Figure 9:
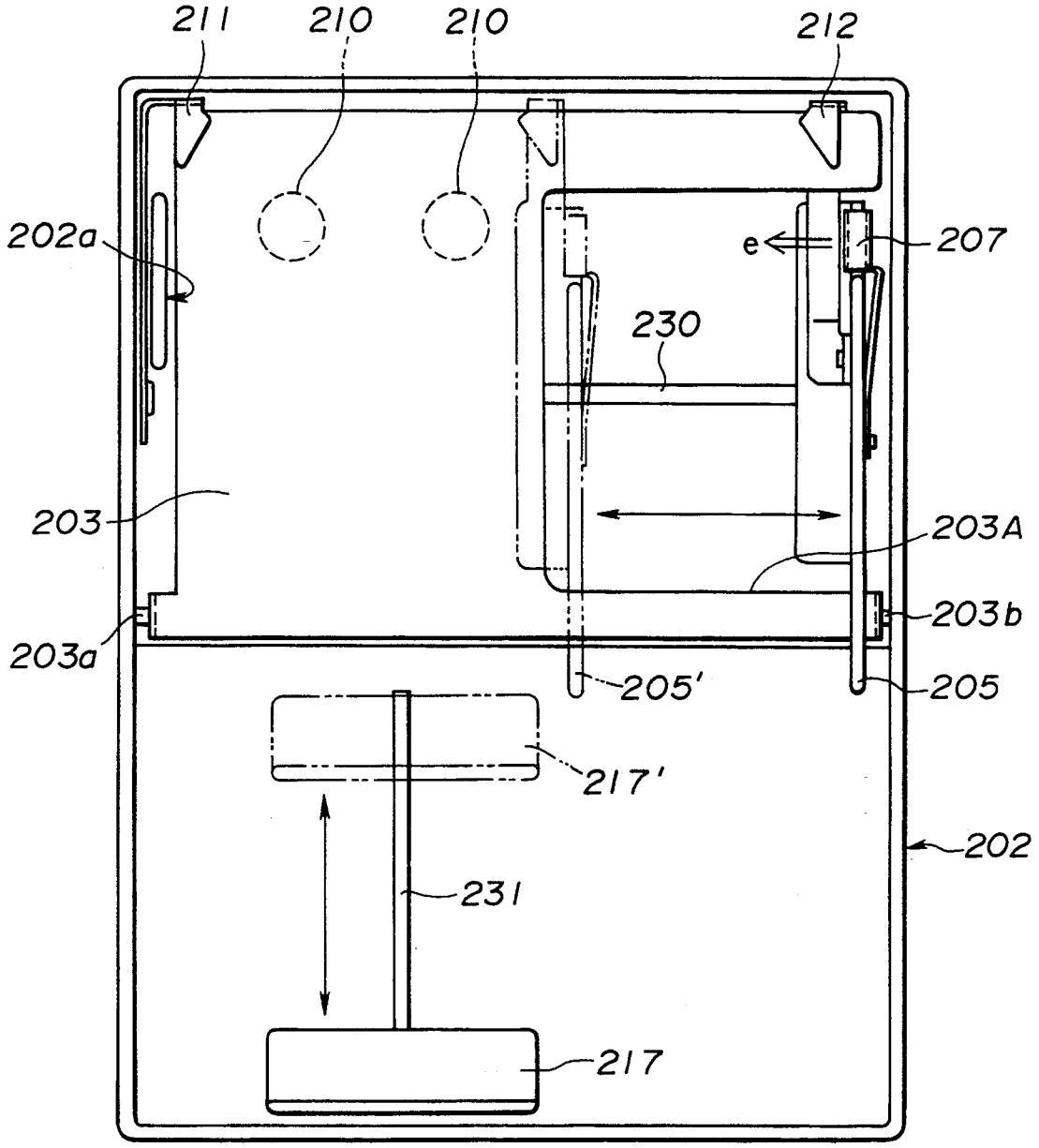
FIG.9 PRIOR ART
FIG. 9 is a plan view of the cassette shown in FIG. 8.

FIGS. 8 and 9 show a conventional universal cassette 201 having a reference plane only at one side.

Side guide plate 205 and rear-end guide plate 217 of cassette 201 are slidable from positions 205 and 217 indicated by solid lines in FIG. 9, respectively, to positions 205' and 217' indicated by two-dot chain lines. Side guide plate 205 and rear-end guide plate 217 are slidable along guide grooves 230 and 231 within main body 202 of the cassette 201, respectively. It is thereby possible to mount on mounting plate 203 sheets P having various sizes within a moving range of side guide plate 205 and rear-end guide plate 217.

Side guide plate 205 has an L shape as viewed from one end whereby a portion extends horizontally. It includes separation pawl 212 having its fulcrum at the side of the plate 205, and side presser 207, both of which move in accordance with the movement of side guide plate 205 so as to be always fitted to predetermined positions of the sheet. Side presser 207 presses the mounted sheets in the direction of arrow e shown in FIG. 9. By virtue of the pressing force of side presser 207, it is possible to always maintain an appropriate mounting state in which sheets P contact reference plane 202*a* of main body 202 of the cassette, even though a certain amount of variations (variations in the dimensions of sheets produced when the sheets are cut, and expansion and contraction caused by humidity) in the sheet size are present, and a gap is produced with respect to the accommodation width of main body 202 of the cassette.

Mounting plate 203 is rotatably supported by supporting shafts 203*a* and 203*b* provided in the cassette. Notch 203A is formed in mounting plate 203 for enabling movement of side guide plate 205. Cassette springs 210 are provided below mounting plate 203 and generate a pressing force toward a sheet-feeding roller (not shown) of the main body of the image forming apparatus (not shown). Sheets P pressed against the sheet-feeding roller are individually separated by two separation pawls 211 and 212 provided at both corners of the leading end of the sheets within main body 202 of the cassette by the rotation of the sheet-feeding roller, and each of the separated sheets is fed into the main body of the apparatus.

In the above-described conventional cassette, however, since the side guide plate 205 interferes with the sheet mounting plate 203 in the moving range of the side guide plate 205, a portion of the sheet mounting plate 203A corresponding to the moving range is cut. Since no member to support sheets is present in the cut portion, the sheets will more easily hang below the sheet mounting plate 203 as the size of the sheet increases and therefore the area of the sheet present over the cut portion increases. As the number of mounted sheets is reduced, the sheets will be bent more easily due to the pressure from the side presser. If the sheets are deformed, separation of the sheets by the separation pawl at a side opposite to the reference side of the side guide plate 205 will not be exactly performed, causing a failure in a sheet feeding operation.

FIGS. 10 through 15 show the preferred embodiments of cassettes in which the above-described problems are overcome.

Figure 10:
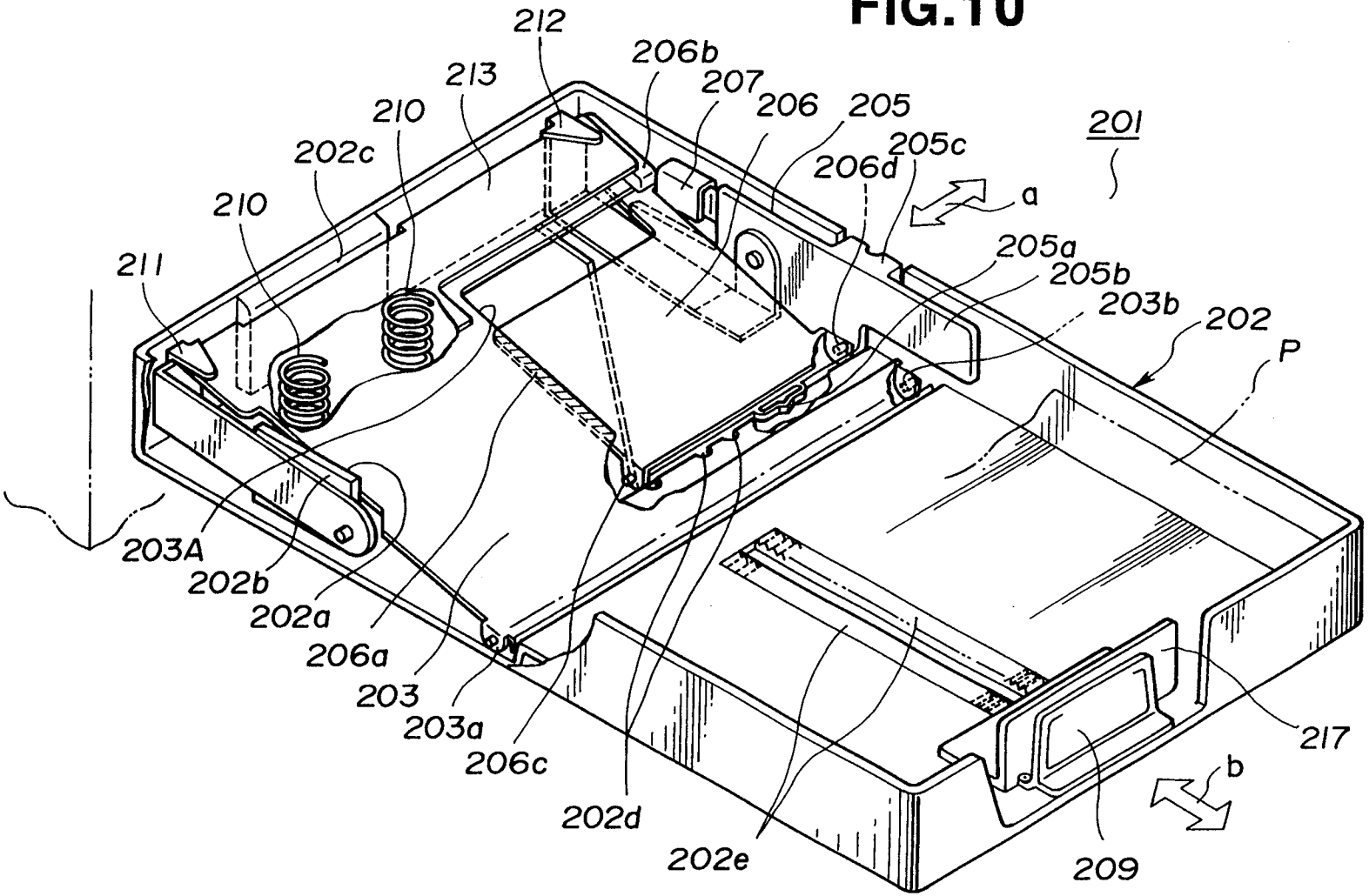
FIG. 10 is a perspective view of a cassette which can be mounted in the copier shown in FIG. 7.
Figure 11:
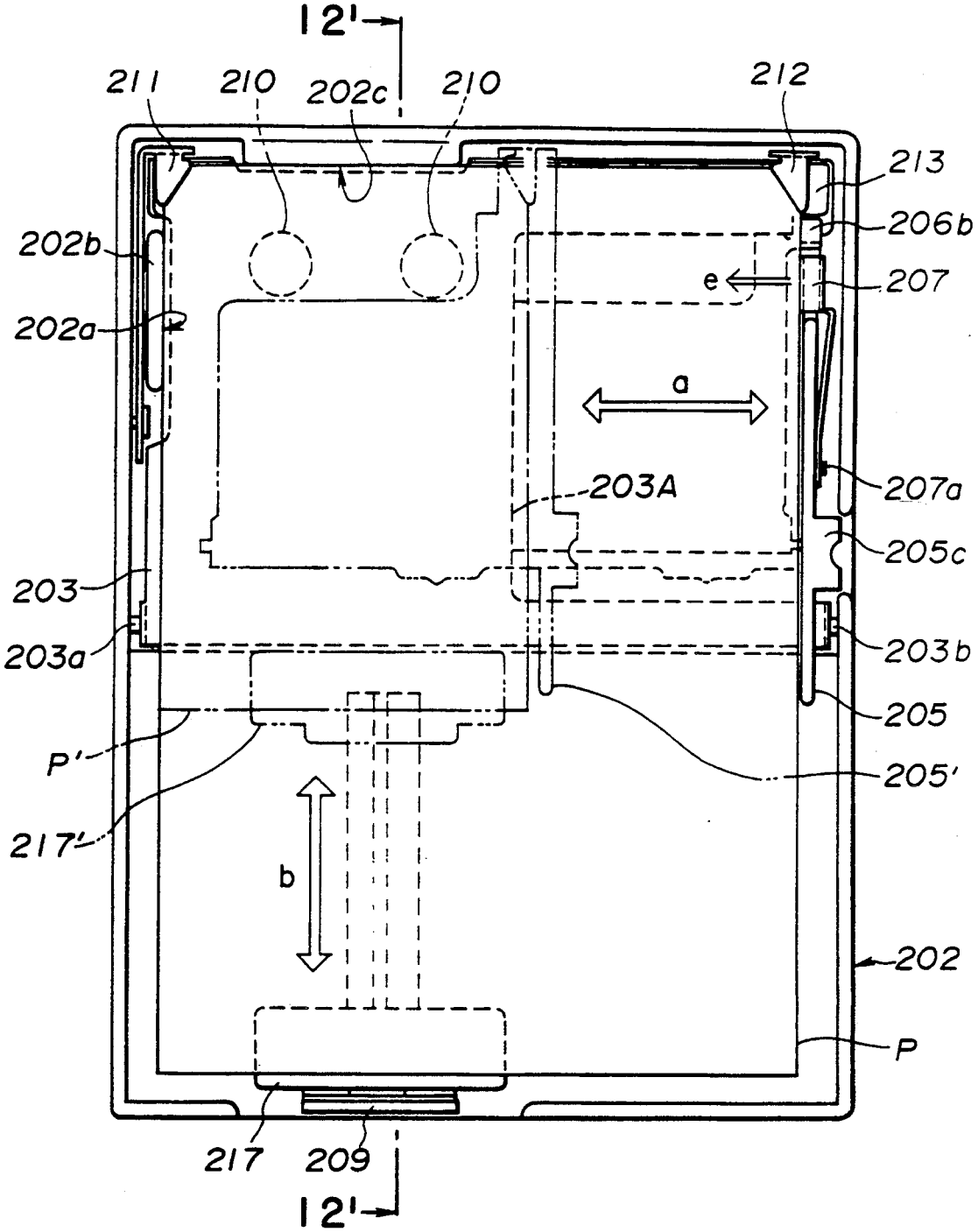
FIG. 11 is a plan view of the cassette shown in FIG. 10.

FIGS. 10 and 11 show universal cassette 201 having a reference plane at one side for feeding sheets P to the image forming apparatus. Mounting plate 203 on which sheets P are mounted is rotatably supported on main body 202 of the cassette by supporting shafts 203*a* and 203*b*. Notch 203A is formed at a side portion of mounting plate 203. Reference member 202*b* for regulating the direction of the lateral width of sheets P is provided at main body 202 of cassette 201. Side guide plate 205 is provided so as to be slidable with respect to reference plane 202*a* of the reference member 202*b*. The lateral width of cassette 201 is set by sliding side guide plate 205 in either of the directions of two-headed arrow "a". In the same manner, rear-end guide plate 217 is provided so as to be slidable with respect to reference plane 202*c* in the direction of the longitudinal width of main body 202 of cassette 201. The longitudinal width of the cassette is set by sliding rear-end guide plate 217 in the directions of two-headed arrow b shown in FIG. 10 by a predetermined amount.

According to the above-described movable guide plates 205 and 217, main body 202 of the cassette can accommodate a plurality of sheet sizes.

Side guide plate 205 is positioned by fitting click spring unit 205*a* of side guide plate 205 in click groove unit 202*d* provided in main body 202 of the cassette. The above-described click spring unit 205*a* can be easily bent by a force produced upon grasping handle 205*c* provided in vertical wall 205*b* of side guide plate 205 and moving side guide plate 205 in the directions of two-headed arrow "a" shown in FIG. 10. The above-described click spring unit 205*a* will allow side guide plate 205 to slide to another position by passing through click groove unit 202*a* while being bent. According to such a configuration, it is possible to slide side guide plate 205 within main body 202 of the cassette within a range from position 205 indicated by solid lines shown in FIG. 11 to position 205' indicated by two-dot chain lines.

Figure 12A:
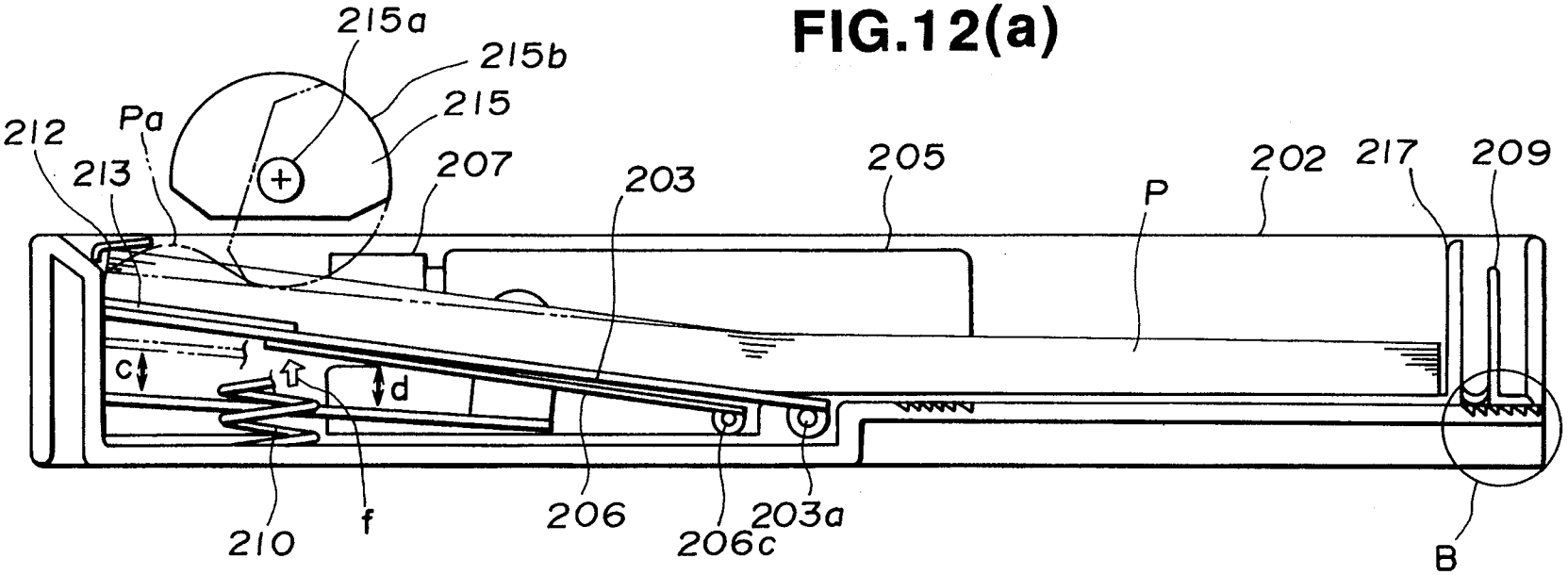
FIG 12(*a*) is a cross-sectional view of the cassette shown in FIG. 11 taken along line 12'—12'.
Figure 12B:
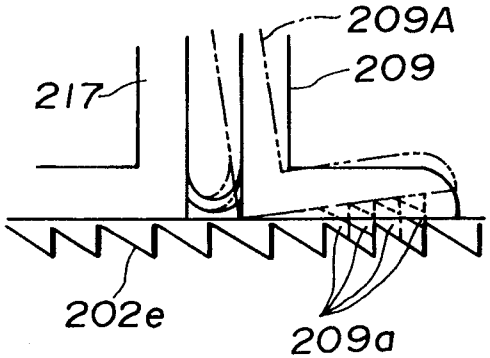

As shown in FIG. 12(*b*), the position of rear-end guide plate 217 is determined by fitting triangular ribs 209*a* provided at the lower surface of rear-end guide plate 217 into triangular grooves 202*e* provided in main body 202 of the cassette. When sliding rear-end guide plate 217 in the directions of two-headed arrow b shown in FIG. 10, knob unit 209 of rear-end guide plate 217 is grasped and displaced to position 209A indicated by two-dot chain lines shown in FIG. 12(*b*). This displacement causes triangular ribs 209*a* to be raised to detach them from triangular grooves 202*e*, whereby rear-end guide plate 217 becomes slidable. According to such a configuration, rear-end guide plate 217 is slidable within main body 202 of the cassette within a range from position 217 indicated by solid lines shown in FIG. 11 to position 217' indicated by two-dot chain lines.

After the side guide plate 205 and rear-end guide plate 217 are positioned in accordance with the size of sheets P to be used according to the above-described operation, sheets P are mounted onto mounting plate 203 within main body 202 of the cassette.

Mounting plate 203 is situated at a position overlapping with sliding side guide plate 205 in the direction of the cross section in its rotational region. Hence, in order to prevent interference with side guide plate 205, notch 203A is formed at a portion of mounting plate 203 corresponding to the sliding region of side guide plate 205.

Auxiliary mounting plate 206 is provided as means for supporting sheets P at the above-described notch 203A of mounting plate 203. Auxiliary mounting plate 206 includes supporting shafts 206*c* and 206*d* for its rotation on side guide plate 205, and slides within main body 202 of the cassette together with side guide plate 205. Although auxiliary mounting plate 206 overlaps with mounting plate 203 in the sliding region of side guide plate 205 (hatched portion 206*a* shown in FIG. 10), auxiliary mounting plate 206 and mounting plate 203 are disposed so that they do not overlap in the direction of the cross section, that is, auxiliary mounting plate 206 is placed below mounting plate 203. Hence, no interference occurs. Leading-end portion 206*b* of auxiliary mounting plate 206 is connected to mounting plate 203 by grasping mounting plate 203. When mounting plate 203 rotates around supporting shafts 203*a* and 203*b* in the directions of two-headed arrow c shown in FIG. 12(*a*), auxiliary mounting plate 206 rotates around supporting shafts 206*c* and 206*d* in the directions of two-headed arrow d shown in FIG. 12(*a*) linked with auxiliary mounting plate 203.

By use of the above-described mounting plate 203 and auxiliary mounting plate 206, sheets P are supported in a flat state over substantially the entire mounting region. The mounted sheets P are urged in the direction of arrow e shown in FIG. 11 by side presser 207 which has its fulcrum 207*a* on side guide plate 205. The pressing force of side presser 207 allows sheets P to be consistently mounted at an appropriate position where sheets P contact reference plane 202*a*, even though variations are present in the size of sheets P, and the width of sheets P is smaller than the set accommodation width of main body 2 of the cassette, producing a gap.

The cassette is mounted within the main body of the apparatus, and, as shown in FIG. 12(*a*), sheets P are fed by sheet-feeding roller 215 provided so as to be rotatable around supporting shaft 215*a* within the main body of the apparatus. Separation pawls 211 and 212 situated at both corners respectively of the leading end of sheets P are used as means for sequentially separating the uppermost sheet of mounted sheets P. While forming a loop Pa in the sheet near separation pawls 211 and 212, the sheet being fed is separated from the adjacent sheet. In order to convey only the uppermost sheet by sheet-feeding roller 218, sheet-feeding roller 215 is made of a material (for example, rubber or the like) whose coefficient of friction with the sheet is higher than the coefficient of friction between the sheets. In order to maintain the above-described relationship with respect to the final sheet, separation sheet 213 is attached to mounting plate 203 to adjust the coefficient of friction.

Cassette spring 210 which has an upwardly pressing force is provided below mounting plate 203 in order to support mounting plate 203, auxiliary mounting plate 206 and mounted sheets P. When sheet-feeding roller 215 is rotated, semicircular portion 215*b* of sheet-feeding roller contacts sheets P in a way that urges downward mounting plate 203 via sheets P, whereby cassette spring 210 is compressed to produce a repulsive force in the direction of arrow f shown in FIG. 12(*a*).

As a result of this repulsive force and the above-described relationship between coefficients of friction, sheet-feeding roller 215 produces a conveying force to feed sheets P to the image forming unit of the main body of the apparatus while sequentially separating the uppermost sheet.

Figure 13:
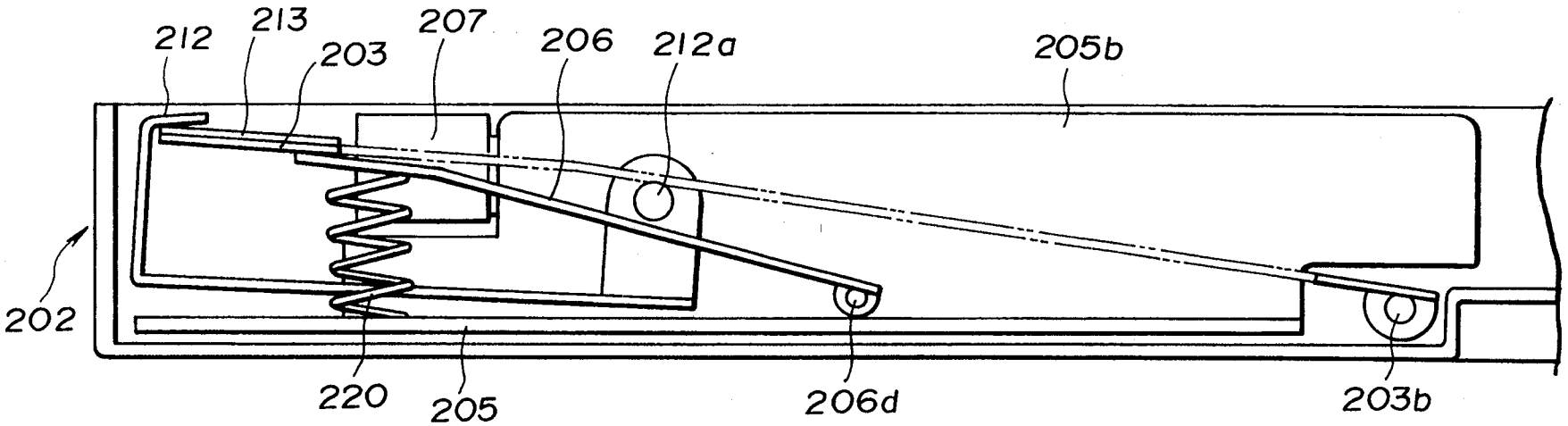
FIG. 13 is a partial vertical cross-sectional view of a portion near a side guide plate of a cassette according to still another embodiment of the present invention.

Although in the above-described embodiment mounting plate 203 is linked with auxiliary mounting plate 206 by grasping mounting plate 203 with leading end 206*b* of auxiliary mounting plate 206, the rotation operation of the two plates may be linked with each other by providing auxiliary spring 220 between auxiliary mounting plate 206 and side guide plate 205 to push auxiliary mounting plate 206 against mounting plate 203 from below by the pressing force of auxiliary spring 220 (see FIG. 13).

Figure 14:
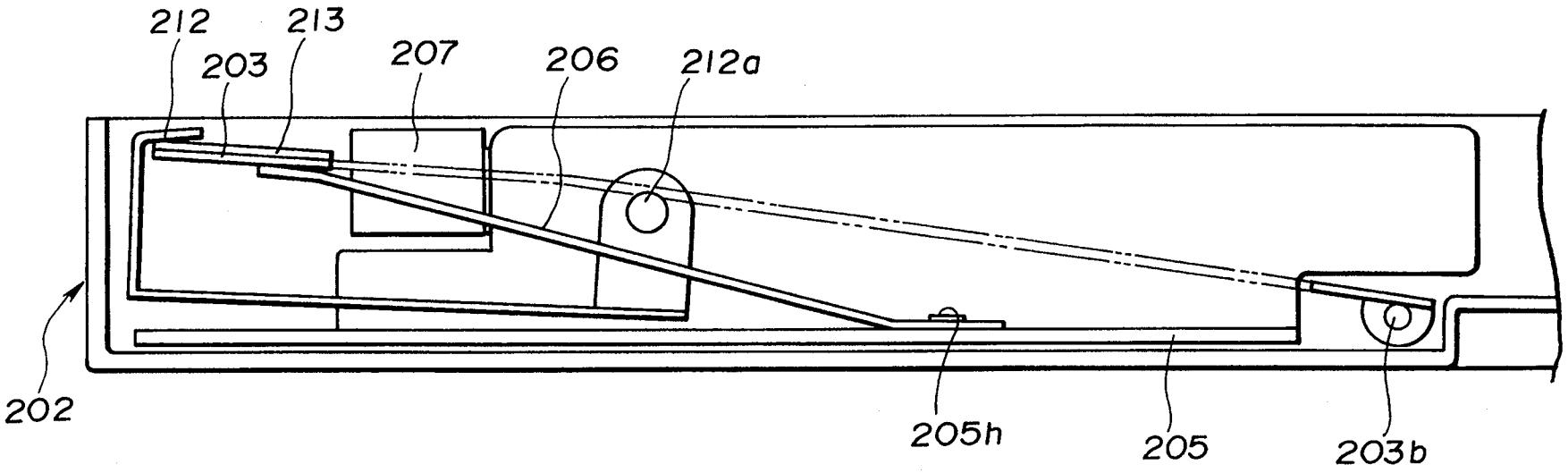
FIG. 14 is a partial vertical cross-sectional view of a portion near a side guide plate of a cassette according to still another embodiment of the present invention.

Alternatively, as shown in FIG. 14, auxiliary mounting plate 206 itself may have a leaf-spring structure having its fulcrum 205*h* on side guide plate 205 to perform a linked rotation with mounting plate 203 by pushing mounting plate 203 upward with the pressing force of auxiliary mounting plate 206 itself.

Figure 15:
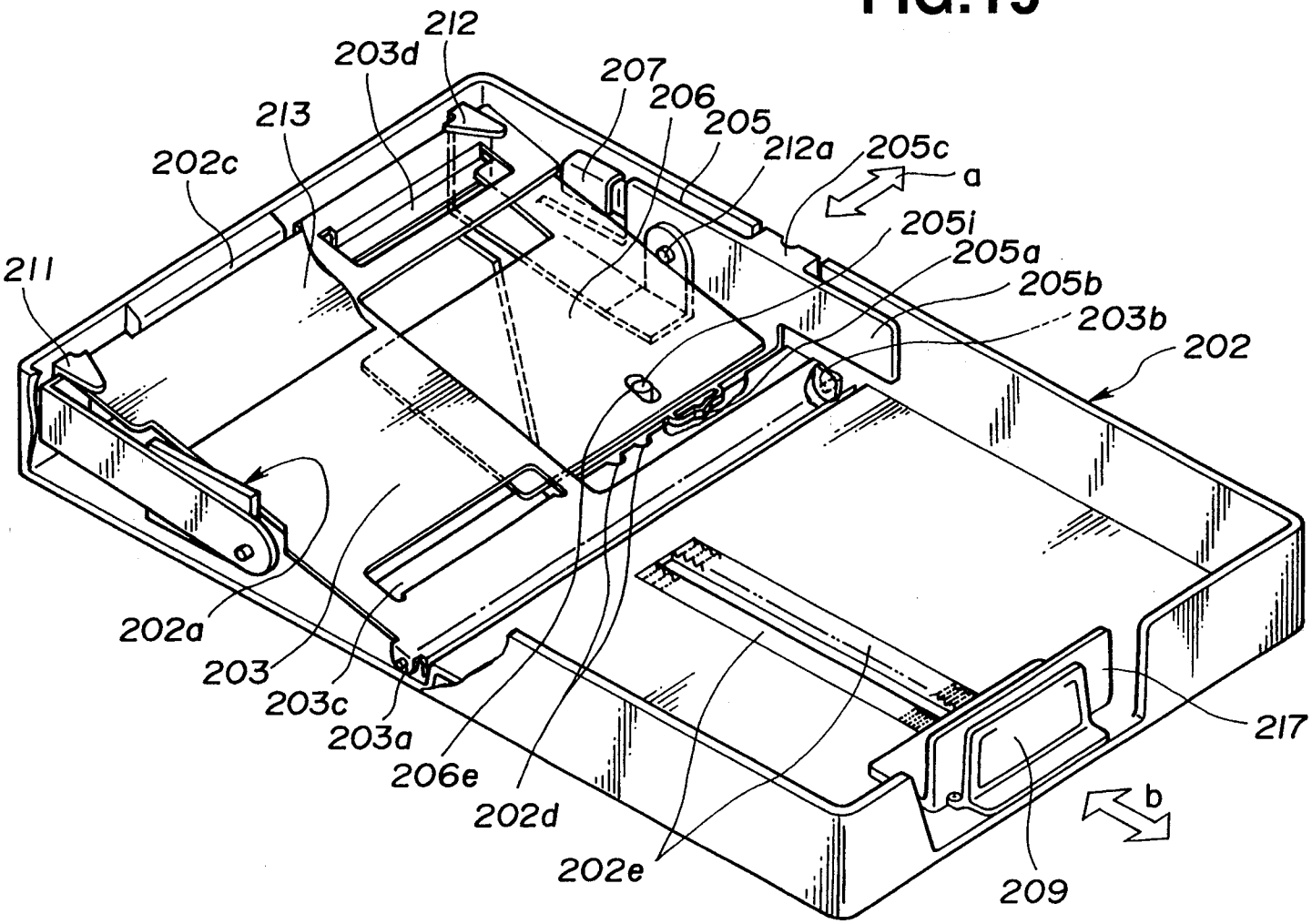
FIG. 15 is a perspective view of a sheet-material mounting unit of a cassette according to still another embodiment of the present invention.

In another approach, as shown in FIG. 15, auxiliary mounting plate 206 may not have supporting shafts for its rotation, but mounting plate 203 may grasp and support auxiliary mounting plate 206 by supporting means 203*c* and 203*d* raised from mounting plate 203, and a linked rotation in the direction of the width of side guide plate 205 may be performed by fitting positioning dowel 205*i* in positioning hole 206*e* of auxiliary mounting plate 206 while having a certain amount of backlash so as to allow vertical movement of auxiliary mounting plate 206.

Not only in a cassette having a reference plane at one side but also in a universal cassette having a reference position at its center, the same effect may, of course, be obtained by applying the above-described configuration to two side guide plates provided at both sides of the cassette.

As described above, by providing an auxiliary mounting plate linked with a sliding movement of a side guide plate in the direction of the width of sheets in a notch of a sheet mounting plate corresponding to the sliding region of the side guide plate, it is possible to maintain mounted sheets in a flat state substantially over the entire region without obstructing the sliding movement of the side guide plate. Consequently, it is possible to prevent a jam of a sheet during a sheet feeding operation due to detachment of the sheet from sheet-separation pawls caused by hanging or bending of the sheet at the notch, and to improve stability in the sheet feeding operation.

Next, a separation auxiliary member provided in the above-described cassette will be described in detail.

Figure 16:
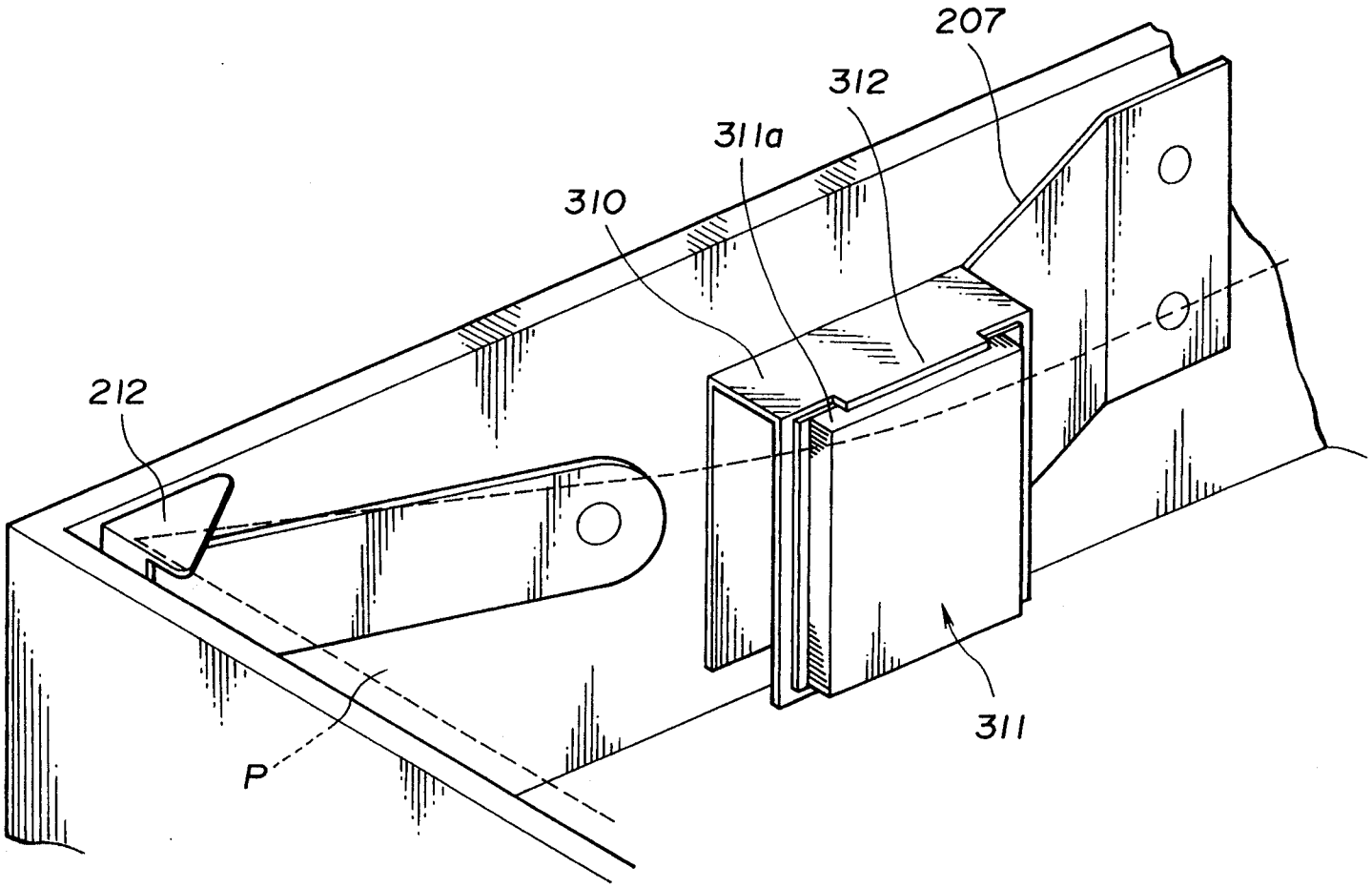
FIG. 16 is a perspective view of a mounting portion of a separation auxiliary member.

In FIG. 16, there is shown a separation auxiliary member 311 that individually separates mounted sheets, and provides a gap between sheets so as to securely separate sheets. Separation auxiliary member 311 is attached to mounting member 310 fixed to a free end of side pressing member 207. Side pressing member 207 presses sheets in the direction of conveying reference plane 202*a* to adjust registration of sheets P in the lateral direction. Mounted sheets P are represented by broken lines.

Figure 17:
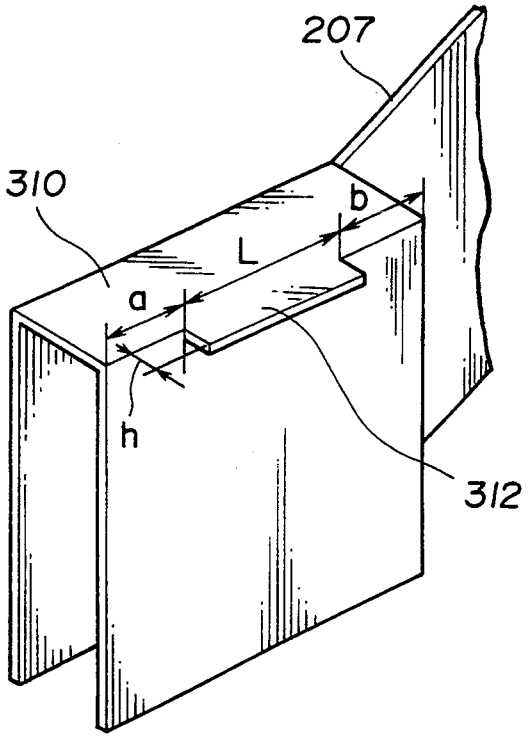
FIG. 17 is a perspective view showing the shape of a protective guide unit shown in FIG. 16.

Protection guide unit 312 prevents exposure of a part of upper side 311*a* of separation auxiliary member 311. As shown in FIG. 17, protection guide unit 312 provides a protection from mounting unit 310 over separation auxiliary member 311, and can be easily and inexpensively formed. It is necessary to appropriately determine the lateral length L of protection guide unit 312 in consideration of the material, dimensions and the like of side pressing member 207, since the length a+b of the remaining portion of mounting unit 310 is obtained in consideration of the strength of side pressing member 207 and a required spring pressure. It is also necessary to appropriately determine the height h of protection guide unit 312. If the height h is much greater than necessary, protection guide unit 312 will damage the lower surface or sides of sheets P when mounting sheets P, or catch the upper surface of sheets P when mounted sheets P are detached, causing a difficulty in operation.

Figure 18:
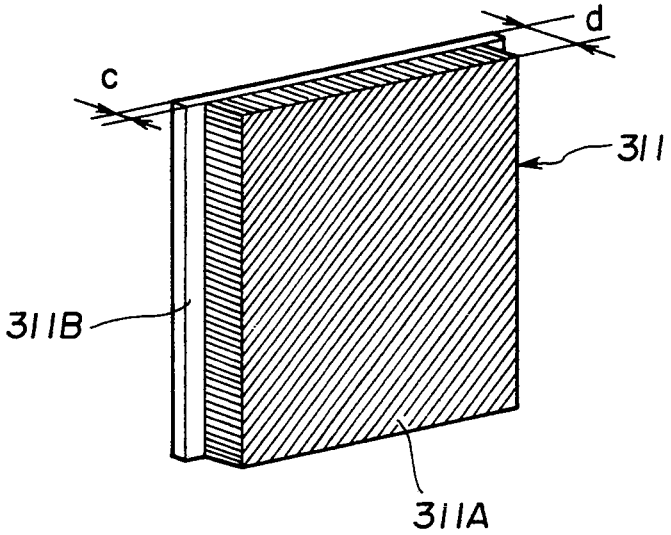
FIG. 18 is a perspective view of the separation auxiliary member shown in FIG. 16.

As shown in FIG. 18, separation auxiliary member 311 comprises vertically-aligned fiber member 311A and base cloth 311B. Vertically-aligned fiber member 311A is highly elastic, and therefore will not interfere with sheets nor peel off while sheets rub against it. Hence, the height h of protection guide unit 312 must be greater than the thickness c of base cloth 311B.

If the height h of protection guide unit 312 is greater than the thickness d of separation auxiliary member 311, protection guide unit 312 will interfere with mounted sheets P when they are detached from within the cassette. Hence, it is desired that the height h be equal to or less than the thickness d. Accordingly, it is suitable to make the height h of protection guide unit 312 to satisfy $c<h\leqq d$.

Figure 19:
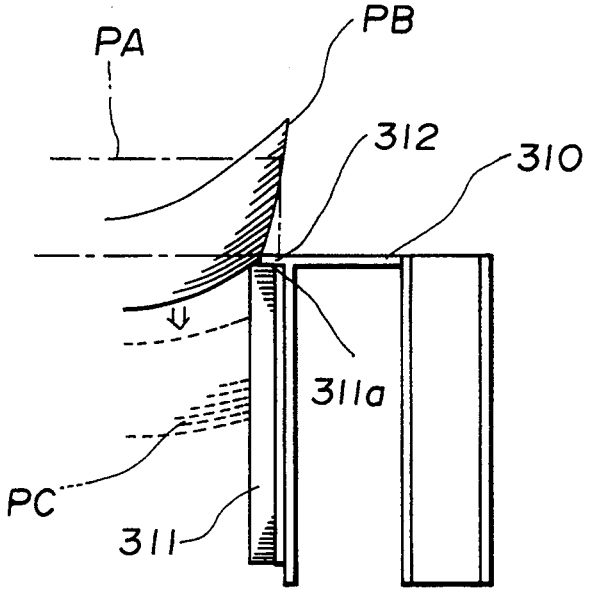
FIG. 19 is a diagram illustrating the function of the protective guide unit and the separation auxiliary member when sheets are mounted.

By providing protection guide unit 312 having the above-described configuration, if sheets are pressed downward after being mounted in state PA, indicated by chain lines shown in FIG. 19, the lower surface of the sheets is pressed against protection guide unit 312, whereby the sheets are bent to state PB as indicated by solid lines.

If the sheets are pressed further, they pass beyond protection guide unit 312 and shift to state PC as indicated by broken lines. As a result, the sheets can be mounted without contacting end portion 311*a* of the separation auxiliary member and deteriorating operability. Furthermore, separation auxiliary member 311 can be attached to protection guide unit 312 while contacting it, whereby advantages in the production process, such as exact positioning, increase of the operational speed, and the like, can be obtained.

Figure 20:
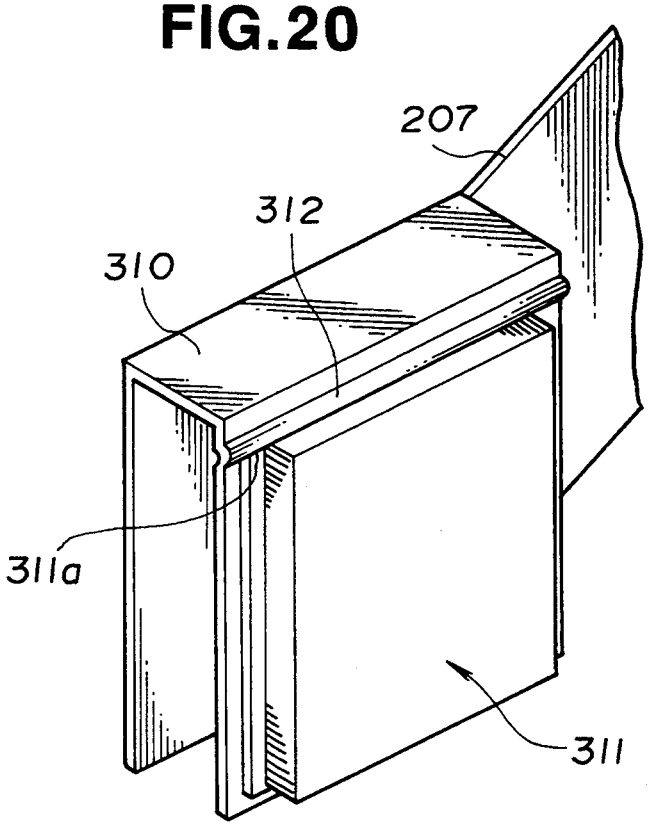
FIG. 20 is a perspective view of a protective guide unit and a separation auxiliary member according to still another embodiment of the present invention.

In the above-described embodiment, since a raised unit is provided in mounting unit 310, protection guide unit 312 can be provided only within a limited range in consideration of the strength of side pressing member 207, and the like. Hence, it is in some cases impossible to prevent exposure of the entire upper end portion of the separation auxiliary member 311. As shown in FIG. 20, by providing protection guide unit 312 comprising a semicircular or square overhang at mounting unit 310 of side pressing member 207, it is possible to prevent exposure of the entire upper end portion of the separation auxiliary member 311.

In the above-described embodiment, protection guide unit 312 is made of the same material as side pressing member 207. Hence, if side pressing member 207 is made of a material having high rigidity, there is the possibility that protection guide unit 312, for example, will interfere with or damage sheets when the sheets are mounted, even though the height h of protection guide unit 312 is not greater than necessary.

Figure 21:
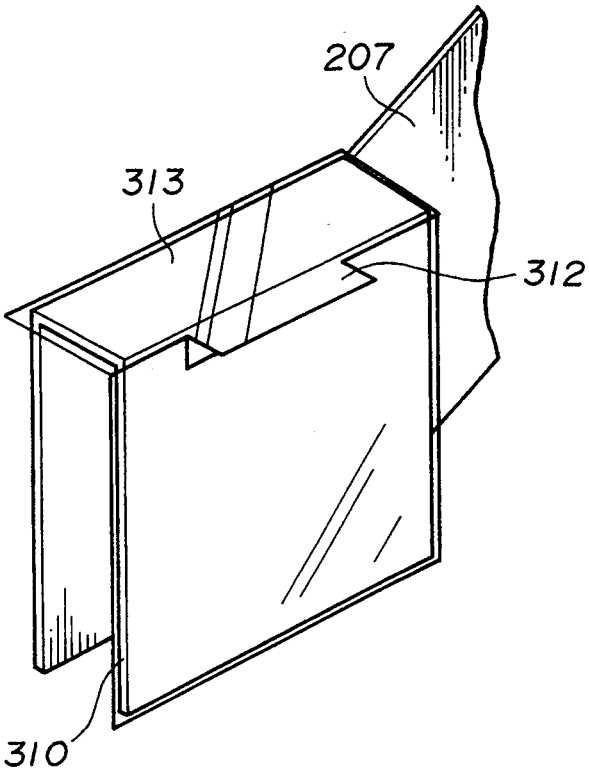
FIG. 21 is a perspective view of a protective guide unit according to still another embodiment of the present invention.
Figure 22:
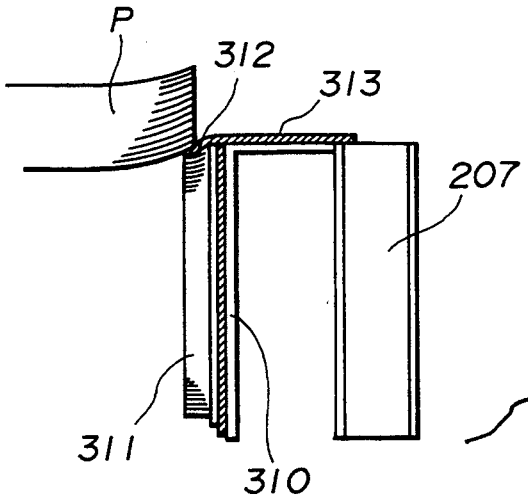
FIG. 22 is a diagram illustrating the function of the protective guide unit shown in FIG. 21 when sheets are mounted.

In order to overcome such problems, as shown in FIG. 21, synthetic-resin film 313, made of polyethylene or the like, and having the same raised portion as in the above-described embodiment, is attached on mounting member 310 of side pressing member 207. Separation auxiliary member 311 is then attached to film 313, as shown in FIG. 22. Protection guide unit 312 itself is also bent when sheets P are mounted, whereby guidability increases, and there is no possibility for protection guide unit 312 to interfere with or damage the sheets when the sheets are mounted.

Figure 23:
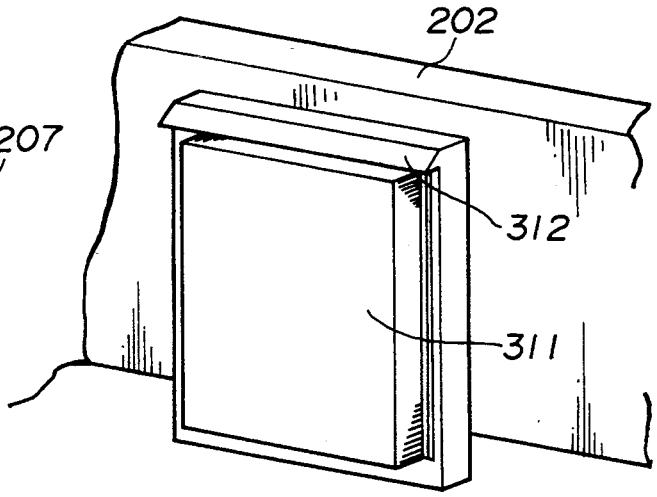
FIG. 23 is a perspective view of a protective guide unit and a separation auxiliary member according to still another embodiment of the present invention.

In the above-described embodiment, a configuration in which separation auxiliary member 311 is attached to side pressing member 207 has been described. However, as shown in FIG. 23, protection guide unit 312 for preventing exposure of the upper end portion of the separation auxiliary member 311 may be formed integral with main body 202 of the cassette.

In the above-described embodiment, the apparatus is configured so that exposure of the upper-end portion of separation auxiliary member 311 is prevented. However, in order to prevent peeling of the lower-end portion of separation auxiliary member 311 when mounted sheets P are detached from the cassette, protection guide unit 312 may also be provided at a lower-end portion of separation auxiliary member 311.

In the above-described embodiment a description has been provided of a configuration in which side pressing member 207 for pressing sides of sheets P mounted in the cassette and conveying reference plane 202*a* are provided within the cassette. However, in some copiers, sheets are conveyed with a reference point in the center of the cassette. Also in such a configuration, separation auxiliary member 311 is in some cases attached on a side of the cassette so as to contact a side of the sheets. In such a case, one may provide protection guide unit 312 as in the above-described embodiment. Furthermore, although in the above-described embodiment a description has been provided of a cassette for a copier, the above-described configuration may be applied to sheet mounting units of all kinds of image forming apparatuses, such as printers and the like.

As described above, in a sheet mounting unit including a separation auxiliary member which contacts a side of mounted sheets and assists separation of the sheets during a sheet feeding operation due to a sheet separating function, a protection guide unit for preventing exposure of part or the entire end portion of the separation auxiliary member is provided. It is thereby possible to prevent rubbing between sheets and an end portion of the separation auxiliary member when the sheets are mounted in or detached from a cassette. Consequently, it is possible to prevent peeling of the separation auxiliary member, a failure in a sheet feeding operation, a failure in a sheet mounting operation, and damage of sheets. Moreover, by attaching the separation auxiliary member on the protection guide unit while contacting therewith, the separation auxiliary member can also function as a positioning member.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A sheet conveying apparatus, comprising:

sheet accommodating means for accommodating a plurality of sheets;

sheet feeding means for feeding sheets from said sheet accommodating means;

separation pawls for individually separating the sheets fed from said sheet feeding means;

a manual feeding port for manually feeding a sheet to a position between said sheet accommodating means and said sheet feeding means; and manually-fed-sheet guiding means disposed between said sheet accommodating means and said sheet feeding means for guiding the sheet manually fed from said manual feeding port, wherein said manually-fed-sheet guiding means is displaceable an amount sufficient to allow formation of a loop in a sheet during the separation by said separation pawls.

2. An apparatus according to claim 1, wherein said sheet feeding means is movable between a feeding position for feeding the sheets from said sheet accommodating means and a standby position separated from the sheets accommodated in said sheet accommodating means, and wherein a notch is formed in said manually-fed-sheet guiding means so that said sheet feeding means can move between said feeding position and said standby position.

3. An apparatus according to claim 1, wherein said sheet feeding means comprises a circular roller a part of whose circumference is cut, and wherein the cut portion faces the sheets accommodated in said sheet accommodating means when the feeding means is in a standby position.

4. An apparatus according to claim 1, wherein said manually-fed-sheet guiding means is made of a plate-like flexible material elastically deformable by pressure from the loop formed in the sheet during the separation by said separation pawls.

5. An apparatus according to claim 1, wherein said separation pawls individually separate the sheets by regulating leading-end corners at both sides of each sheet.

6. An apparatus according to claim 5, wherein said manually-fed-sheet guiding means is displaceable only at portions corresponding to said separation pawls.

7. An apparatus according to claim 1, wherein said manually-fed-sheet guiding means comprises a guide member for guiding the sheet fed from said manual feeding port to a position not contacting said sheet feeding means.

8. A sheet conveying apparatus, comprising:

sheet accommodating means for accommodating a plurality of sheets;

sheet feeding means for feeding sheets from said sheet accommodating means;

separation pawls for individually separating the sheets fed from said sheet feeding means;

conveying means for conveying the sheets separated by said separation pawls;

guiding means, disposed substantially parallel to the sheets accommodated in said sheet accommodating means and in close proximity to said separation pawls, for guiding sheets fed between said sheet accommodating means and said sheet feeding means to said conveying means, wherein said guiding means is displaceable an amount sufficient to allow formation of a loop in a sheet during the separation by said separation pawls.

9. An apparatus according to claim 8, wherein said manually-fed-sheet guiding means is made of a plate-like flexible material elastically deformable by pressure from the loop formed in the sheet during the separation by said separation pawls.

10. An apparatus according to claim 8, wherein said conveying means comprises a pair of rotating rollers for conveying the sheets.

11. An image forming apparatus, comprising:

sheet accommodating means for accommodating a plurality of sheets;

sheet feeding means for feeding sheets from said sheet accommodating means;

separation pawls for individually separating the sheets fed from said sheet feeding means;

a manual feeding port for manually feeding a sheet to a position between said sheet accommodating means and said sheet feeding means;

manually-fed-sheet guiding means disposed between said sheet accommodating means and said sheet feeding means for guiding the sheet manually fed from said manual feeding port; and image forming means for forming an image on sheets fed from said sheet accommodating means and said manual feeding port, wherein said manually-fed-sheet guiding means is displaceable an amount sufficient to allow formation of a loop in a sheet during the separation by said separation pawls.

12. An image forming apparatus according to claim 11, wherein said image forming means comprises an ink-jet recording unit in which recording is performed by supplying electric currents to electrothermal transducers in accordance with an image signal, and discharging ink from discharging ports utilizing the growth of bubbles caused by heating exceeding film boiling by the electrothermal transducers.

* * * * *

UNITED STATES PATENT AND TRADEMARK OFFICE

CERTIFICATE OF CORRECTION

PATENT NO. : 5,364,195
DATED : November 15, 1994
INVENTOR(S) : SHINJI KANEMITSU, ET AL.

It is certified that error appears in the above-indentified patent and that said Letters Patent is hereby corrected as shown below:

Column 1,
line 44, "accommodatad" should read --accommodated--.
Column 3,
line 56, "$P_2$is" should read --$P_2$ is--; and
line 58, "$P_2$contacts" should read --$P_2$ contacts--.

Signed and Sealed this

Twenty-first Day of March, 1995

*Attest:*

Bruce Lehman

BRUCE LEHMAN

*Attesting Officer*

*Commissioner of Patents and Trademarks*